US007293381B2

(12) United States Patent
Primiano et al.

(10) Patent No.: US 7,293,381 B2
(45) Date of Patent: Nov. 13, 2007

(54) DISPLAY DEVICE FOR A COOLER DOOR

(75) Inventors: Bernard Primiano, Marietta, GA (US); James David Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 495 days.

(21) Appl. No.: 10/994,919

(22) Filed: Nov. 22, 2004

(65) Prior Publication Data

US 2006/0107565 A1 May 25, 2006

(51) Int. Cl.
*G09F 11/12* (2006.01)

(52) U.S. Cl. ..... 40/472; 40/518

(58) Field of Classification Search ..... 40/472, 40/524, 118, 471, 518, 117
See application file for complete search history.

(56) References Cited

U.S. PATENT DOCUMENTS 2,200,533 A * 5/1940 Borregard ..... 40/472
3,389,483 A * 6/1968 Piper ..... 40/472
3,616,554 A * 11/1971 Singer et al. ..... 40/471
3,726,031 A * 4/1973 Singer ..... 40/471
3,754,342 A * 8/1973 Santacroce et al. ..... 40/477
5,355,601 A * 10/1994 Paulsen ..... 40/471
5,410,830 A * 5/1995 Aiken, Sr. ..... 40/518
5,517,778 A * 5/1996 Simson ..... 40/471
5,953,840 A * 9/1999 Simson et al. ..... 40/471
6,105,290 A * 8/2000 Coates et al. ..... 40/518
6,178,674 B1 * 1/2001 Decaux et al. ..... 40/471
6,247,256 B1 * 6/2001 Simson et al. ..... 40/471
6,688,027 B2 * 2/2004 Fink ..... 40/611.08
6,922,928 B2 * 8/2005 Shih ..... 40/438
2004/0025389 A1 * 2/2004 Peterson ..... 40/524
2006/0218829 A1 * 10/2006 Chen ..... 40/524

* cited by examiner

*Primary Examiner*—William L Miller
(74) *Attorney, Agent, or Firm*—John L. James

(57) ABSTRACT

A display device for mounting on an inside surface of a cooler door has a mounting bracket for attaching to the cooler door, a top tube mounted on the first mounting bracket, and a bottom tube mounted on the first mounting bracket below the top tube. A display scroll is entrained about the top and bottom tubes so that the scroll is visible through the cooler door. As the scroll is rotated about the tubes, a display graphic on the scroll moves to attract the attention of potential consumers.

10 Claims, 3 Drawing Sheets

Fig. 3
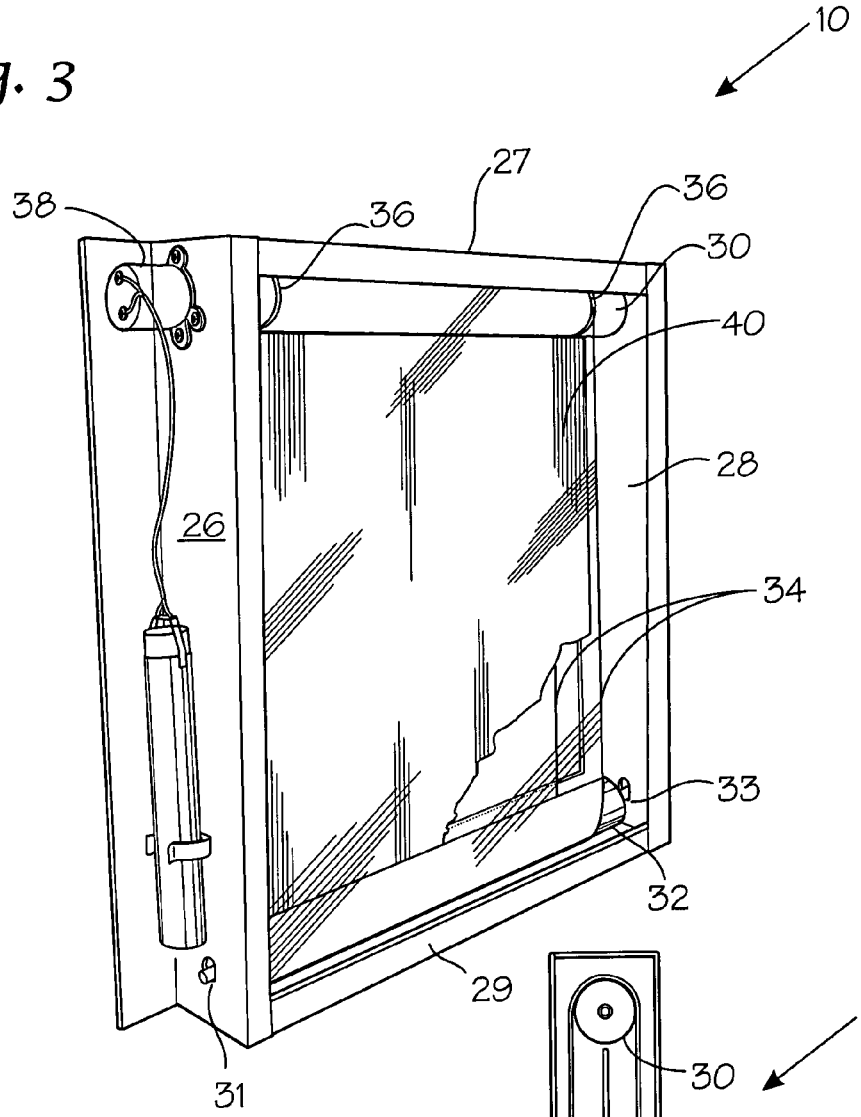
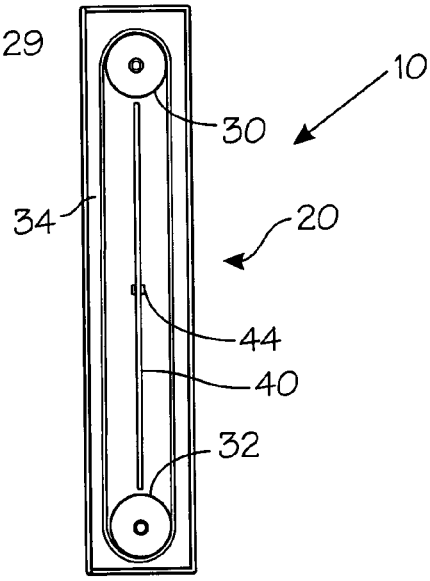
Fig. 4

DISPLAY DEVICE FOR A COOLER DOOR

TECHNICAL FIELD OF THE INVENTION

This invention relates generally to a cooler, and, more particularly, to a display device for a transparent cooler door.

BACKGROUND OF THE INVENTION

Upright coolers in supermarkets and convenience stores typically have transparent glass doors so that the products inside are visible. It is now common to use the inside of the door for shelving as is done in household refrigerators. Door shelving fits against the door so that the product containers are visible, however the product labels do not always face forward for easy identification of the product. Some shelves have a small area for affixing product identification, but such small areas lack the impact needed, especially for impulse purchases. Accordingly, it will be appreciated that it would be highly desirable to have a cooler door display device with a large area for product labeling and identification.

Some coolers have display panels or other advertising material affixed to the front of the cooler door where it has maximum visibility. Some panels have raised portions to further increase visibility and interest. While such front panels and raised panels are highly visible, they present static images. Static images often lack the sensory impact needed to spur impulse buying. Accordingly, it will be appreciated that it would be highly desirable to have a cooler door display device with an attention grabbing feature.

SUMMARY OF THE INVENTION

The present invention is directed to overcoming one or more of the problems set forth above. Briefly summarized, according to one aspect of the present invention a display device for an inside surface of a cooler door comprises a frame having opposed top and bottom panels and opposed first and second side panels with the panels defining a window; a first upright member attached to the first side panel and having an inside surface and an outside surface; and a second upright member attached to the second side panel and having an inside surface facing the inside surface of the first upright member. A top tube is mounted on the first and second upright members behind the top panel of the frame. A bottom tube is mounted on the first and second upright members behind the bottom panel of the frame. A display scroll is entrained about the top and bottom tubes so that the scroll is visible through the window.

As the scroll is rotated about the tubes, a display graphic on the scroll moves to attract the attention of potential consumers. Being at the cooler door, the graphic remains visible at all times in contrast to actual product which may be located at the rear of the cooler shelf where it is difficult to recognize. A display panel can be used with a transparent scroll. The display panel attaches to the bottom tube and the scroll graphic travels in front of the display panel and behind the display panel. During breaks in the scroll graphic, the display graphic is visible.

These and other aspects, objects, features and advantages of the present invention will be more clearly understood and appreciated from a review of the following detailed description of the preferred embodiments and appended claims, and by reference to the accompanying drawings

BRIEF DESCRIPTION OF THE DRAWINGS

FIG. 3 is a perspective rear view of the display device of FIG. 1.

FIG. 4 is a diagrammatic side view of the display device of FIG. 1 with the right upright removed.

DETAILED DESCRIPTION OF THE PREFERRED EMBODIMENTS

Figure 1:
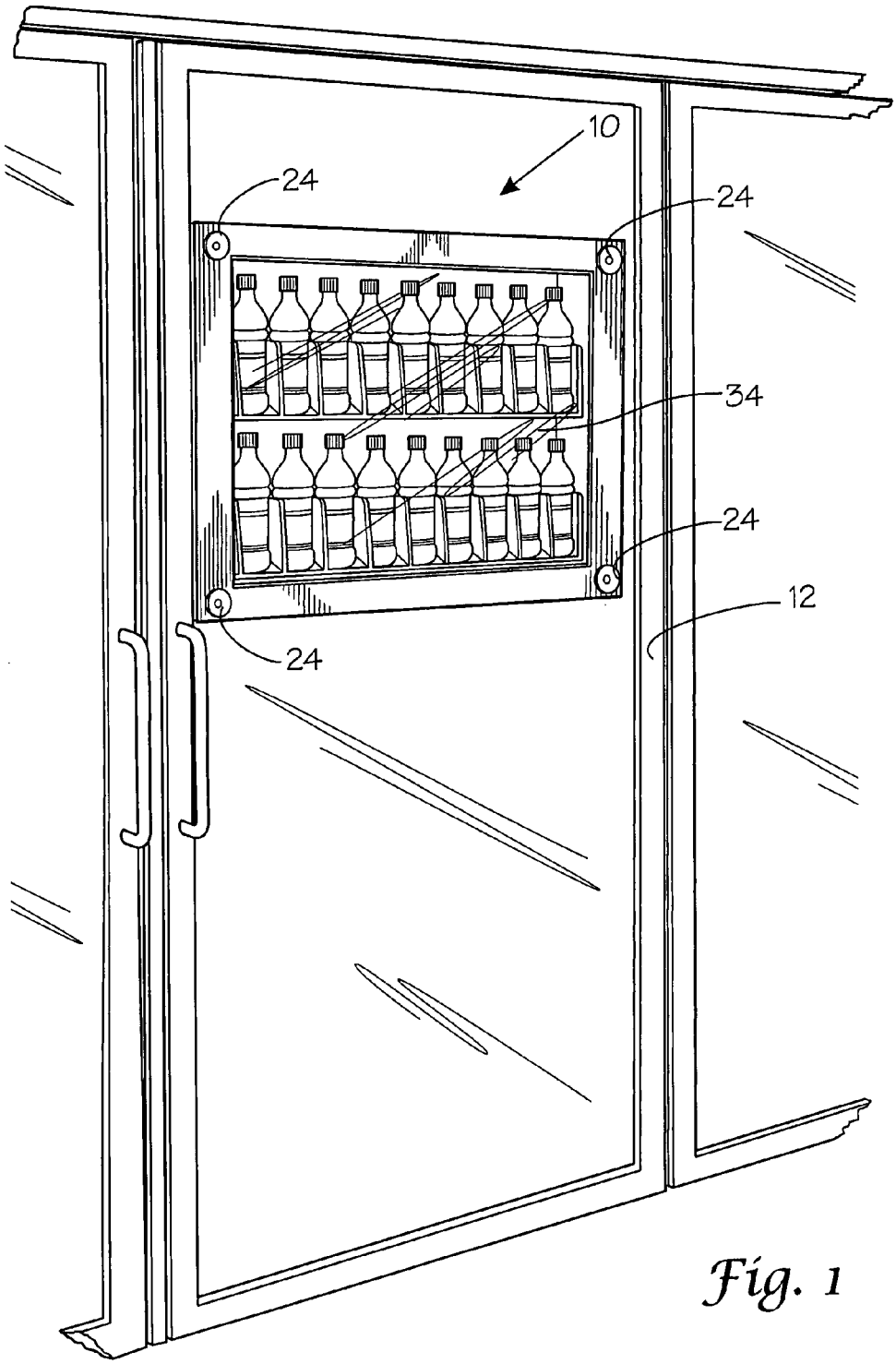
FIG. 1 is a front view of a preferred embodiment of a display device attached to the inside surface of an upright cooler door according to the present invention.
Figure 2:
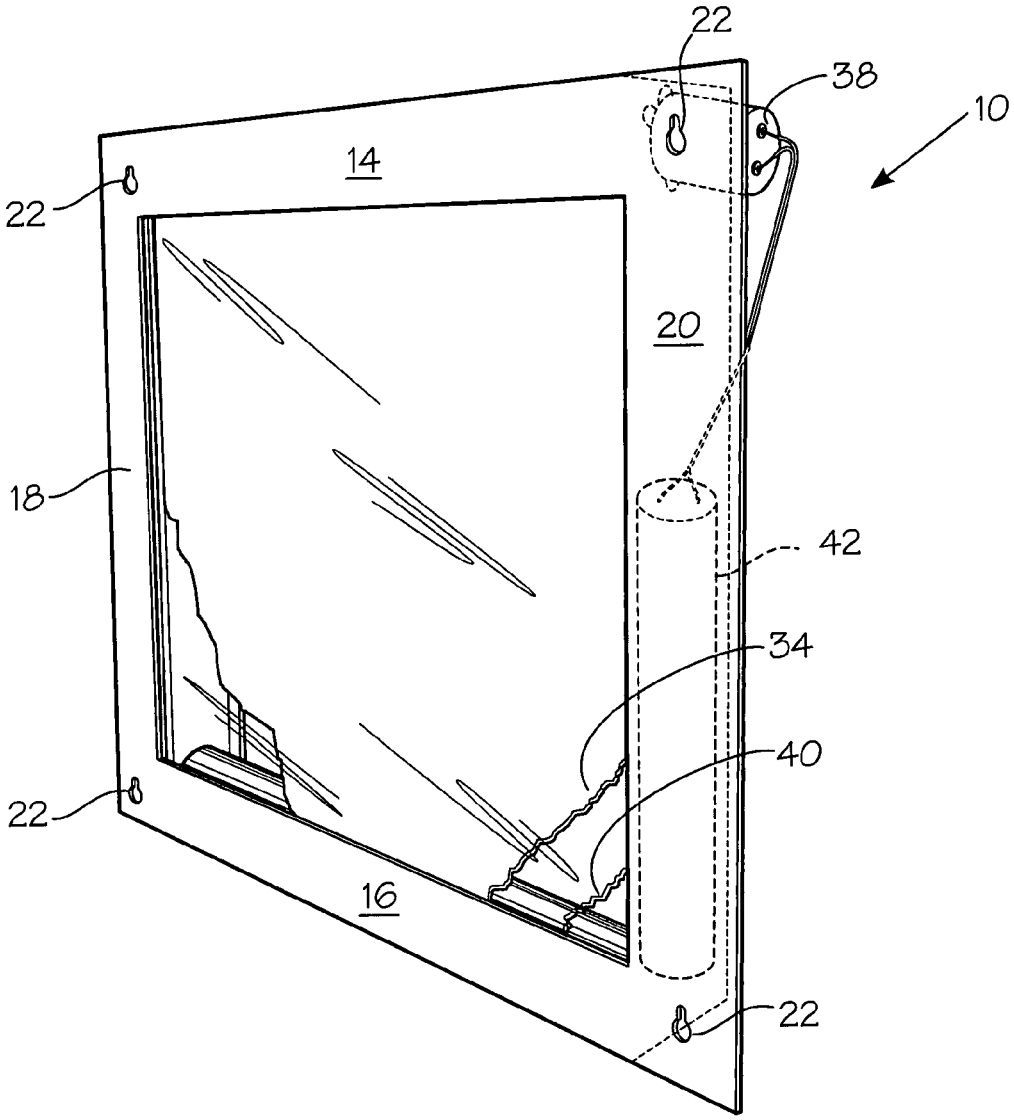
FIG. 2 is a perspective front view of the display device of FIG. 1.

Referring to FIGS. 1-4, a display device 10 for an inside surface of a door 12 of a cooler such as those used for beverages and other refrigerated products. As illustrated, door 12 is hinged on the right and has a handle on the left for convenient opening by a right-handed consumer. Display device 10 has a frame having opposed top and bottom panels 14, 16 and opposed left and right side panels 18, 20. Panels 14, 16, 18, 20 define a window through which the graphics of the device are viewed. The frame is preferably constructed of cardboard or the like and equipped with keyways 22 in side panels 18, 20, or more preferably, in top and bottom panels 14, 16 to receive protruding portions of suction cups 24.

A right upright member 26 is attached to right side panel 20. Upright member 26 has an inside surface facing toward the window and an outside surface facing away from the window. A left upright member 28 is attached to left side panel 18 and has an inside surface facing the inside surface of right upright member 24. Each upright member preferably has a general L-shaped cross section, and, when attached to its associated side panel, forms a C-channel structure which increases rigidity and structural integrity. A top horizontal member 27 is attached to top panel 14 and extends between the left and right upright members 28, 26. A bottom horizontal member 29 is attached to bottom panel 16 and also extends between the left and right upright members 28, 26. Each horizontal member preferably has a general L-shaped cross section, and, when attached to its associated top or bottom panel, forms a C-channel structure which increases rigidity and structural integrity.

A top tube 30 is mounted on the upper portions of left and right upright members 28, 26 and extends therebetween behind the top panel 14 of the frame. A bottom tube 32 is mounted on the lower portions of left and right upright members 28, 26 and extends therebetween behind the bottom panel 16 of the frame. Bottom tube 32 has its ends mounted in left and right longitudinal slots 33, 31 in the upright members 28, 26 and has freedom to move vertically to maintain scroll tension.

A display scroll 34 is entrained about the top and bottom tubes 30, 32 so that the scroll is visible through the window. The scroll 34 is preferably an endless piece of flexible material. To increase scroll traction, one or more rubber bands 36 may encircle top tube 30, or top tube 30 may be coated with a substance to increase friction and thereby improve traction.

A motor 38 powered by an energy pack or battery 42 and mounted on the right upright member 26 provides a means for rotating display scroll 34. Where the cooler door 12 is hinged on the left, motor 38 can be mounted on left upright member 28. As illustrated, motor 38 is attached to right upright member 26 outside the window.

A display panel 40 stands upright above bottom tube 32 and is encircled by display scroll 34. Panel 40 may be attached to one or both of the upright members 26, 28 with an adhesive or the like, or may attached with a clip 44 or the like. Optionally, panel 40 can attach to tube 32 where such tube is constructed to have a stationary portion. A graphic design may appear on panel 40 to be used in conjunction with graphics on display scroll 34. For such an application, display scroll 34 may be constructed of acetate or other transparent, flexible material so that panel 40 is visible through selected areas of the scroll graphic. It is also possible to combine the stationary graphics on panel 40 with the moving graphic on scroll 34 to form a single graphic with motion.

While the invention has been described with particular reference to the preferred embodiments, it will be understood by those skilled in the art that various changes may be made and equivalents may be substituted for elements of the preferred embodiments without departing from invention. For example, As illustrated, each upright member is a single continuous member but may be bifurcated and comprised of upper and lower brackets spaced from one another. Spaced brackets have the advantage of saving weight but the disadvantage of presenting a less finished appearance. It is accordingly intended that the claims shall cover all such modifications and applications as do not depart from the true spirit and scope of the invention.

| Element List | |
|---|---|
| 10 | display device |
| 12 | cooler door |
| 14 | top frame panel |
| 16 | bottom frame panel |
| 18 | left frame panel |
| 20 | right frame panel |
| 22 | keyways |
| 24 | suction cups |
| 26 | right upright member |
| 27 | top horizontal member |
| 28 | left upright member |
| 29 | bottom horizontal member |
| 30 | top tube |
| 31 | right slot |
| 32 | bottom tube |
| 33 | left slot |
| 34 | display scroll |
| 36 | rubber band |
| 38 | motor |
| 40 | display panel |
| 42 | energy pack |
| 44 | clip |

What is claimed is:

1. A display device for an inside surface of a cooler door, comprising:

a frame having opposed top and bottom panels and opposed first and second side panels, said panels defining a window;

a first upright member having an inside surface and an outside surface and being attached to said first side panel;

a second upright member attached to said second side panel and having an inside surface facing said inside surface of said first upright member;

a top tube mounted on said first and second upright members behind said top panel of said frame;

a bottom tube mounted on said first and second upright members behind said bottom panel of said frame;

a display scroll visible through said window and entrained about said top and bottom tubes forming an endless loop; and means for rotating said display scroll about said top and bottom tubes so that said endless loop continuously encircles both of said tubes; and a display panel upstanding above said bottom tube, at least one of said first and second upright members containing a clip and said display panel being held by said clip.

2. A display device, as set forth in claim 1, wherein said means for rotating said display scroll includes a motor.

3. A display device, as set forth in claim 2, wherein said motor is mounted on said first upright member.

4. A display device, as set forth in claim 3, wherein said motor is attached to said top tube.

5. A display device, as set forth in claim 4, including at least one traction increasing device on said top tube adapted to increase traction between said scroll and said top tube as said endless loop continuously encircles both of said tubes.

6. A display device, as set forth in claim 1, wherein said first and second upright members each define a longitudinal slot and wherein said bottom tube is mounted in said slots, said bottom tube being free to move vertically in said slots to maintain scroll tension.

7. A display device, as set forth in claim 1, including:

means for mounting said frame, said frame defining keyways for receiving said mounting means.

8. A display device, as set forth in claim 7, wherein said mounting means includes a suction cup.

9. A display device, as set forth in claim 1, wherein said display scroll encircles said display panel as said endless loop continuously encircles both of said tubes.

10. A display device for an inside surface of a cooler door, comprising:

a frame having opposed top and bottom panels and opposed first and second side panels, said panels defining a window;

a first upright member having an inside surface and an outside surface and being attached to said first side panel;

a second upright member attached to said second side panel and having an inside surface facing said inside surface of said first upright member;

a top tube rotatably mounted on said first and second upright members behind said top panel of said frame;

a bottom tube rotatably mounted on said first and second upright members behind said bottom panel of said frame;

a display scroll visible through said window and entrained about said top and bottom tubes forming an endless loop;

a motor attached to said first upright member outside said window and attached to one of said top and bottom tubes to thereby rotate same so that said endless loop continuously encircles both of said tubes; and a display panel upstanding above said bottom tube, at least one of said first and second upright members containing a clip and said display panel being held by said clip.

* * * * *